US010030390B2

(12) United States Patent
Svensson

(10) Patent No.: US 10,030,390 B2
(45) Date of Patent: Jul. 24, 2018

(54) PREFABRICATED ROOF PLATE ELEMENT AND METHOD FOR ITS PRODUCTION

(71) Applicant: Peehr Mathias Ørnfeldt Svensson, Skanderborg (DK)

(72) Inventor: Peehr Mathias Ørnfeldt Svensson, Skanderborg (DK)

( * ) Notice: Subject to any disclaimer, the term of this patent is extended or adjusted under 35 U.S.C. 154(b) by 0 days.

(21) Appl. No.: 14/769,642

(22) PCT Filed: Feb. 20, 2014

(86) PCT No.: PCT/DK2014/050037
§ 371 (c)(1),
(2) Date: Aug. 21, 2015

(87) PCT Pub. No.: WO2014/127783
PCT Pub. Date: Aug. 28, 2014

(65) Prior Publication Data

US 2016/0002924 A1 Jan. 7, 2016

(30) Foreign Application Priority Data

Feb. 21, 2013 (DK) ..... 2013 70097

(51) Int. Cl.
*E04C 3/00* (2006.01)
*E04C 3/06* (2006.01)
(Continued)

(52) U.S. Cl.
CPC ..... *E04C 3/06* (2013.01); *E04B 7/22* (2013.01); *E04C 3/07* (2013.01); *E04D 3/352* (2013.01);
(Continued)

(58) Field of Classification Search
CPC ..... E04C 3/06; E04C 3/07; E04C 2003/0473; E04C 3/29; E04D 3/352; E04B 7/22
(Continued)

(56) References Cited

U.S. PATENT DOCUMENTS 1,307,187 A * 6/1919 Disbro ..... E04F 15/04 52/592.1
2,180,317 A 5/1939 Davis
(Continued)

FOREIGN PATENT DOCUMENTS

CN 2089032 11/1991
CN 1070024 3/1993
(Continued)

OTHER PUBLICATIONS

Danish Search Report for International Application No. PCT/DK2014/050037 dated May 14, 2014.
(Continued)

*Primary Examiner* — Basil S Katcheves
(74) *Attorney, Agent, or Firm* — Dykema Gossett PLLC

(57) ABSTRACT

This inventions is a prefabricated roof plate element (6) comprising load carrying girders including longitudinal upper and lower steel frame parts placed at opposed sides of the roof plate element. The girders are corrugated at opposing upper and lower sides in the longitudinal direction at which vertical side walls of the steel frame parts are interconnected connection plates which are part of the load carrying girders. The lower steel frame parts (4) preferably are interconnected by an integral steel panel part (8) forming the bottom of the roof plate element and a ceiling of a building. The prefabricated roof plate element has uniform roof plate elements (20, 54) which are interconnected side by side, to form a wider prefabricated roof plate element. Cavities thereof are filled with insulation material and afterwards provided with a common top plate construction (70, 72) and a common roof foil covering (74).

10 Claims, 14 Drawing Sheets

(51) Int. Cl.

| | |
|---|---|
| ***E04B 7/22*** | (2006.01) |
| ***E04C 3/07*** | (2006.01) |
| ***E04D 3/35*** | (2006.01) |
| *E04C 3/29* | (2006.01) |
| *E04C 3/04* | (2006.01) |

(52) U.S. Cl.
CPC ..... *E04C 3/29* (2013.01); *E04C 2003/0473* (2013.01)

(58) Field of Classification Search
USPC ..... 52/852, 489.1, 461, 463
See application file for complete search history.

(56) References Cited

U.S. PATENT DOCUMENTS 2,910,152 A * 10/1959 Edgar ..... E04B 5/48 174/39
3,267,626 A * 8/1966 Daly ..... E04C 2/08 52/145
3,300,912 A 1/1967 Shumaker
3,708,943 A * 1/1973 Thomas ..... E04D 3/30 52/309.8
3,889,437 A * 6/1975 Day ..... E04D 3/364 52/489.1
3,995,080 A * 11/1976 Cogburn ..... B64C 1/064 244/123.3
4,089,145 A * 5/1978 DeVries, Jr. ..... E04D 3/365 52/461
4,135,342 A * 1/1979 Cotter ..... E04D 13/165 52/406.1
4,168,596 A * 9/1979 Yoder, Jr. ..... E04D 3/30 52/462
4,361,998 A * 12/1982 Ellison ..... E04D 3/363 52/463
4,423,581 A * 1/1984 Miller ..... E04D 3/30 52/461
4,467,582 A * 8/1984 Hague ..... E04D 3/363 52/419
4,476,658 A * 10/1984 Johnstone ..... E04D 3/366 52/395
4,649,684 A * 3/1987 Petree ..... E04D 3/366 52/395
4,982,545 A 1/1991 Stromback
5,134,825 A * 8/1992 Berridge ..... E04D 3/362 52/463
5,737,892 A * 4/1998 Greenberg ..... E04D 3/366 52/469
6,038,828 A * 3/2000 Backman ..... E04C 2/08 52/588.1
6,321,504 B1 * 11/2001 Svensson ..... E04B 7/22 52/650.1
6,691,482 B1 * 2/2004 Ault ..... E04D 3/3603 165/57
7,407,219 B2 * 8/2008 Glasgow ..... B60R 19/18 293/120
7,418,807 B1 9/2008 Ryan et al.
7,493,729 B1 2/2009 Semmes
7,540,123 B1 * 6/2009 Semmes ..... E04C 2/292 52/783.14
7,703,256 B2 * 4/2010 Haddock ..... F16B 5/0004 52/24
7,818,937 B2 * 10/2010 Monsieur ..... E04D 3/32 52/525
8,186,132 B2 * 5/2012 Howery, Jr. ..... E04B 1/08 52/262
2003/0226331 A1 12/2003 Lindberg et al.
2010/0281821 A1 11/2010 Frobosilo

FOREIGN PATENT DOCUMENTS

| | | | |
|---|---|---|---|
| CN | 1131362 | | 12/2003 |
| FR | 1491552 | | 7/1967 |
| GB | 2451193 | A | 1/2009 |
| KR | 20120080736 | | 7/2012 |
| WO | 02092937 | | 11/2002 |
| WO | 2008125109 | A1 | 10/2008 |
| WO | 2011116409 | A1 | 9/2011 |
| WO | 2011137478 | A1 | 11/2011 |
| WO | 2012113406 | A1 | 8/2012 |

OTHER PUBLICATIONS

English Abstract of KR 20120080736.
English Abstract of CN 2089032.
English Abstract of CN 1070024.

* cited by examiner

PREFABRICATED ROOF PLATE ELEMENT AND METHOD FOR ITS PRODUCTION

Reference is made to Danish Patent Application No. PA 2013 70097, filed 21 Feb. 2013, and PCT Application No. PCT/DK2014/050037, the priorities of which are claimed.

BACKGROUND OF THE INVENTION

Field of the Invention

The present invention relates to a prefabricated roof plate element, the invention also relates to a prefabricated load carrying girder preferably for use in prefabricated roof plate according to the invention, and the invention also relates to a method for the production of prefabricated roof plate elements according to the invention.

DESCRIPTION OF THE PRIOR ART

Prefabricated roof girders and roof plate elements, respectively, can be made totally from inorganic materials, which is very significant to their durability and maintenance. It is of great significance that the roof plate elements can have a free span of up to 22 meters, that is, one single roof plate element may cover on the order of about 80 $m^2$, which of course is very essential with regard to reducing of the construction time and costs.

EP2145056A1 (WO2008/125109A1) discloses a prefabricated roof plate element, including one or more longitudinal box-shaped roof girders that each have two predominantly U-shaped steel sections which at mutually facing open sides are interconnected along narrow outwardly bent lateral edges. The roof girders are connected at upper and lower narrow sides corrugated in the longitudinal direction with steel plates corrugated in the transverse direction and have approximately the same width as the roof plate element. The roof girders/support girders and roof plate element, respectively, are designed with reduced height at an end part for forming eaves.

WO2012/113406A discloses a roof girder having two predominantly U-shaped steel sections with the lower and upper sides facing each other, and are designed with narrow outwardly bent edges. The roof girder at opposing upper and lower narrow sides are corrugated in the longitudinal direction. The steel sections at the upper and lower open sides, respectively, are interconnected by of connecting plates or partitionings which are fastened tosubstantially vertical sides of the steel sections in such a way that there is a spacing between the narrow outwardly bent edges of the respective lower and upper steel sections.

SUMMARY OF THE INVENTION

Object of the Invention

The invention is a new and improved prefabricated plate-shaped roof element providing both cheaper and improved plate-shaped roof elements.

The prefabricated roof plate element according to the invention has vertical side walls of the steel frame parts which are interconnected by longitudinal connection plates forming parts of the load carrying girders. The lower steel frame parts furthermore are preferably interconnected by an integral steel panel forming respectively the bottom of the roof plate element and a ceiling of a building. By simple provisions, a new and improved prefabricated roof plate element, which furthermore may be cheaper to produce is achieved.

It is emphasized that the lower steel frame parts are integrated with a steel panel parts forming the bottom of the roof plate element resulting in the production of the roof plate elements being carried out with a minimum of manual working hours which results in quicker and cheaper production and minimized prices.

The prefabricated roof plate element according to the invention may preferably be provided uniform roof plate elements which are interconnected side by side to form a wider prefabricated roof plate element. The cavities are filled with insulation material, and afterwards are provided with a common top plate construction and a common roof foil covering.

Appropriately, the prefabricated roof plate element according to the invention has a common top plate construction including steel panel plates provided with transverse corrugations and on top thereof semi-hard insulation plates and the common roof foil covering.

Advantageously, the prefabricated roof plate element according to the invention may respectively have the integral steel panel part forming the bottom of the roof plate element and a ceiling of a building is provided with a large number of perforations and possibly an upper fabric cover to improve the acoustic qualities of the bottom of the roof plate element.

Alternatively, the prefabricated roof plate element according to the invention may respectively have the integral steel panel part forming the bottom of the roof plate element and a ceiling having transverse corrugations to improve the stiffness and carrying qualities of the bottom of the roof plate element.

Additionally, in order to improve the general stiffness and carrying capacity, it may be advantageous that the prefabricated roof plate element according to the invention may respectively have the integral steel panel part forming the bottom of the roof plate element and a ceiling of a buildinghaving longitudinal corrugations to improve the general stiffness and carrying qualities of the bottom of said roof plate element.

The invention also relates to a prefabricated load carrying girder, preferably for use in prefabricated roof plate elements according to the invention. The prefabricated load carrying girder has a longitudinal upper and lower steel frame parts provided with longitudinal corrugations to improve the general stiffness and carrying qualities of the load carrying girders. The vertical side walls of the upper and lower steel frame parts are interconnected by longitudinal connection plates, and that preferably plate-shaped insulation material is inserted between the longitudinal connection plates.

The invention makes possible building up plate-shaped roof elements in-situ by use of prefabricated load carrying girders and by mounting the steel panel part forming the bottom of the plate-shaped roof element and a ceiling of a building. Preferably, the in-situ mounted combined bottom and ceiling plates may be provided with longitudinal or transverse corrugations to improve the general stiffness and carrying qualities of the bottom of the plate-shaped roof element.

Afterwards, the upwardly open central hollowness of the in situ build up plate-shaped roof element is filled with a suitable insulation material, before the plate-shaped roof element is closed upwardly with transversely corrugated steel panels. Finally, upper semi-hard insulation plates and an uppermost roof foil covering are mounted on the corrugated steel panels.

Furthermore, the invention relates to a method for the production of prefabricated roof plate elements comprising the following method steps: continuously unrolling from a supply roll a thin steel blank having a total width similar to that of the partial width of the wall parts of a lower steel plate frame part to be bent upwardly from a part unrolled from a supply roll which is preferably a middle part of the thin steel blank to form a central lower bottom part of the lower steel plate frame and a ceiling in a building;

continuously bending upward opposed end parts of the steel blank to form at least lower longitudinal corrugations and lower, vertical side panels;

continuously unrolling from another supply roll, a thin steel blank having a total width like that of the upper steel plate side frame parts which are to be bent upwardly;

continuously bending upwardly opposed end parts of the steel blank unrolled from another supply roll to form at least an upper longitudinal corrugation and upper vertical side panels;

situating longitudinal vertical connection plate members in the longitudinal corrugation which are interconnected between the upper and lower vertical side panels to form an upwardly-open girder construction;

interconnecting side by side additional upwardly-open girder constructions to create a wider roof plate element having upwardly-open cavities filled with insulation material; and closing the wider roof plate element upwardly by use of transverse corrugated steel panels and on top thereof by use of common insulation plates (semi-hard) and a common roof foil covering.

Alternatively the method according to the invention may comprise further method steps:

a thin steel blank, having a total width similar to that of the steel plate frame part to be bent up, is continuously unrolled from a supply roll as the middle part of the thin steel blank to form a central lower bottom part of the steel plate frame which is provided with perforations, the lower bottom part at a side facing upwardly has an upper fabric cover to improve acoustic qualities of a bottom of the roof plate element as well as providing a vapor tight membrane.

According to a further alternative, the inventive method can comprise the further method step:

that the interconnection between the vertical side panels of the upper and lower steel plate frame and the longitudinal vertical connection plate panels are carried out by at least one connection means or methods which are screws, clinching, gluing, assembling of combined sealing lips and profiles or welding.

A still further method according to the invention may comprise the further method steps: a thin steel blank having a total width like that of the steel plate frame part to be bent upwardly is continuously unrolled from a supply roll at the middle part of the thin steel blank for forming a central lower bottom part of the steel plate frame which is provided with longitudinal corrugations to improve the free span carrying capacity of a roof plate element interconnected side-by-side upwardly open steel plate frame parts, etc.

BRIEF DESCRIPTION OF THE DRAWINGS

The prefabricated roof plate element according to the invention is described in more details in the accompanying drawing in which.

DETAILED DESCRIPTION OF THE INVENTION

Figure 1:
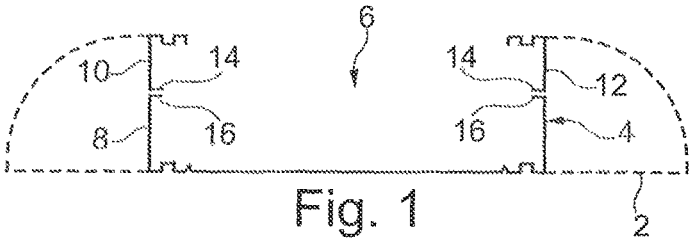
FIG. 1 shows a plane schematic sectional view illustrating how a preferred embodiment of a method for the production of a prefabricated plate-shaped roof element according to the invention may be produced.

FIG. 1 illustrates how an embodiment of a longitudinal carrying steel frame 4 for a plate-shaped roof element 6 is continuously upwardly bent from a thin steel blank 2 as the latter is unrolled from a supply roll (not shown).

The total width of the steel blank 2 corresponds to the total length of the respective partial wall parts of at least a longitudinal lower steel frame part 8.

A narrow thin steel blank is continuously bent upward to form an upper left and right hand side of plate-shaped frame parts 10 and 12, before longitudinal narrow bend-in edges 14 are interconnected with similar longitudinal narrow bend-in edges 16 of the lower steel frame part 8.

In order to prevent or reduce thermal connections between the narrow bend-in edges 14 and 16, special sealant tapes may be positioned between the narrow bend-in edges 14 and 16 before the interconnection of these parts.

Figure 2:
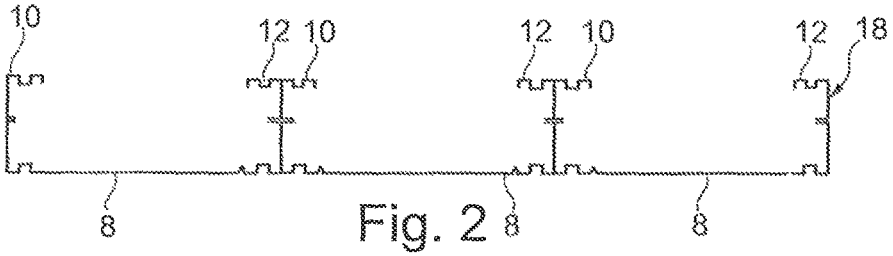
FIG. 2 shows a plane schematic view illustrating another embodiment of a method of the production of prefabricated plate-shaped roof element made from more side by side interconnected roof elements as shown in FIG. 1.

FIG. 2 shows a wider, lower steel frame 18 built up by interconnecting three side-by-side lower steel frame parts 8.

According to an important aspect of the invention, the building-up of the plate-shaped roof element 6 may take place in a mobile factory arranged in one or more containers or buildings.

In order to maintain a correct vapor barrier between the assembled lower frame parts 8, special sealant tapes may be used between the lower external side parts of the lower frame parts 8. Such sealant tapes may furthermore have electric leads for activating the adhesive effect of the sealant tapes.

Alternatively, the longitudinal narrow bend-in edges 14 and 16 may be substituted for by narrow bend-out edges such that the interconnections are placed at the outside of the plate-shaped element 6 and the interior longitudinal joints would be plane without disturbing the projecting parts such that it would be possible to make use of interior longitudinal connection plate members 36 as described by later embodiments (FIGS. 4 and 5) according to the invention.

Figure 3:
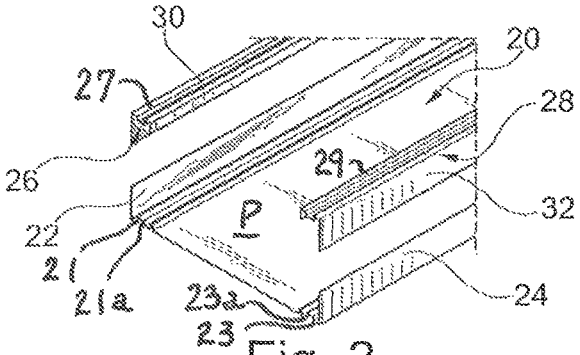
FIG. 3 shows a perspective view illustrating another embodiment of a method for the production of steel plate frame parts for a prefabricated plate-shaped roof element according to the invention.

FIG. 3 depicts an alternative embodiment of a longitudinal carrying steel frame 20. Lower left and right hand side steel frame parts 21 and 23 include respective upwardly-extending vertical outer side panels 22 and 24, which are planar, that is, without the above-mentioned inwardly-bent narrow edges 16 (FIG. 1). In a corresponding manner, the upper left and right hand side steel frame parts 26 and 28 are also made with respective downwardly-extending vertical outer planar side wall panels 30 and 32.

Figure 4:
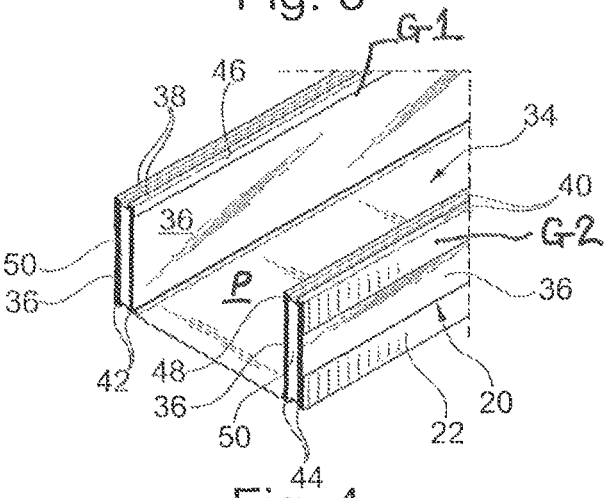
FIG. 4 shows a perspective view illustrating how steel plate frame parts as shown in FIG. 2 at opposite sides is provided with a pair of longitudinal connection element members interconnecting the steel plate frame parts.

FIG. 4 shows a similar girder-like construction 34 wherein longitudinal, vertical connection plate members 36 are positioned in longitudinal corrugations 38 and 42 in top and bottom walls 27 and 21*a* of the respective upper and lower left hand side frame parts, and in corrugations 40 and 44 in top and bottom walls 29 and 23*a* of the respective upper and lower right hand side frame parts 28 and 23, thus providing left and right girders G1 and G2 with a steel panel part P therebetween. It can be appreciated from the FIG. 2 embodiment that panel part P is integral with the bottom walls 21*a* and 23*a* of the lower left and right hand side frame parts 21 and 23.

Furthermore, innermost narrow, vertical side wall panels 46 and 48 of the upper left and right hand side steel frame parts 28 and 30 may be positively connected along the interior upper side edges of the innermost of the longitudinal connection plate members 36.

The positive connections between the vertical side panels of the respective upper and lower steel plate frame and the longitudinal, vertical connection plate members 36, including the interconnection of the inwardly bent short edges, are carried out by one or more of the following connecting means or methods which are screws, clinching, gluing, assembling of combined sealing lips and profiles or welding.

Furthermore, FIG. 4 shows that the longitudinal narrow cavities 50 between the longitudinal connection plate members 36 are filled with a suitable insulating material. The same is the case in FIG. 5, where the central cavity 52 of the longitudinal carrying steel frame 20 is filled with a suitable insulation material.

Figure 6:
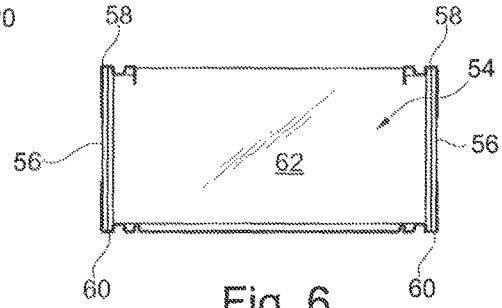
FIG. 6 shows a plane sectional view of a modified embodiment plate-shaped roof element provided at opposite sides with only one longitudinal connection member disposed between the respective steel frame parts.

FIG. 6 shows a plane sectional view of an alternative embodiment for a longitudinal carrying steel frame part 54. Only longitudinal connection plate members 56 are provided between the outermost respective upper and lower corrugations 58 and 60. The central cavity again is filled with a suitable insulating material 62.

Figure 7:
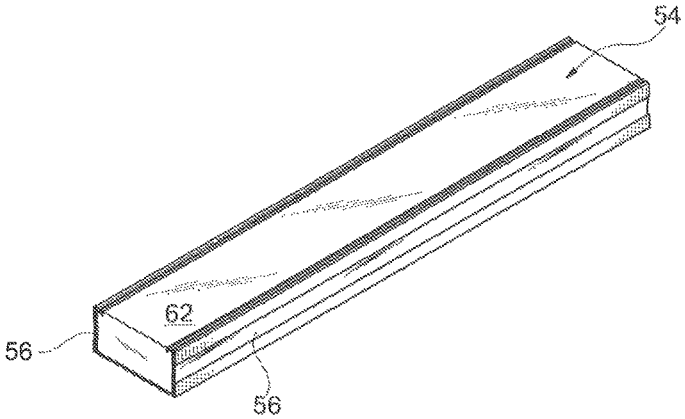
FIG. 7 shows a perspective view of a narrow plate-shaped roof element having a cross section of the modified plate-shaped roof element of FIG. 6.

FIG. 7 shows a perspective view of the longitudinal carrying steel frame part 54.

Figure 8:
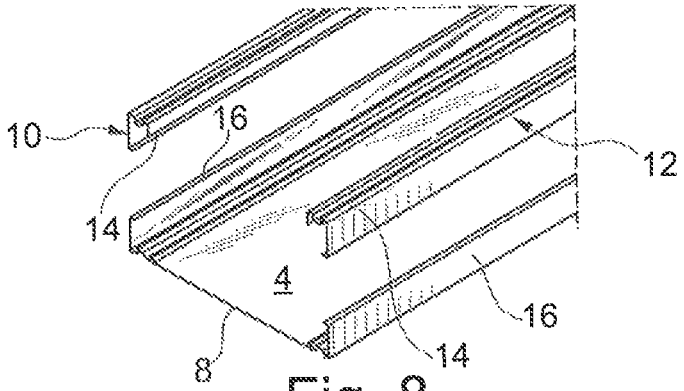
FIG. 8 shows a perspective view illustrating in principle an embodiment of a method for the production of steel plate frame parts for a prefabricated plate-shaped roof element similar to that of FIG. 3 according to the invention.
Figure 9:
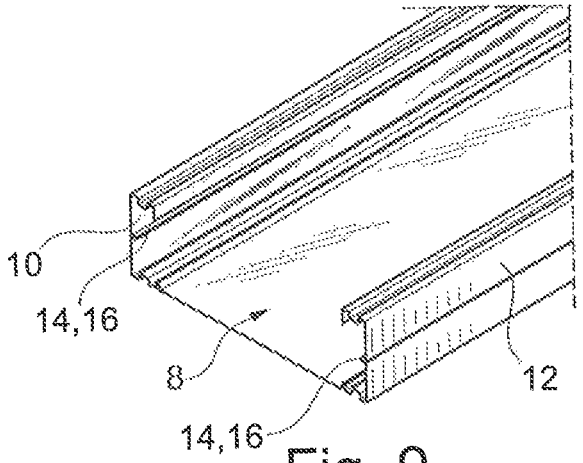
FIG. 9 shows a perspective view of a further embodiment of a steel plate frame for a plate-shaped roof element where the interconnections between the respective steel sections at opposite sides are provided between narrow inwardly bent edges of the steel sections.

FIGS. 8 and 9 show perspective views of an embodiment for a longitudinal carrying steel frame similar to that of FIG. 1. Longitudinal narrow bend-in edges 14 of upper left and right hand side plate-shaped frame parts 10 and 12 of a plate-shaped roof element 6 are interconnected with similar longitudinal narrow bend-in edges 16 of the longitudinal lower steel frame part 8.

Figure 10:
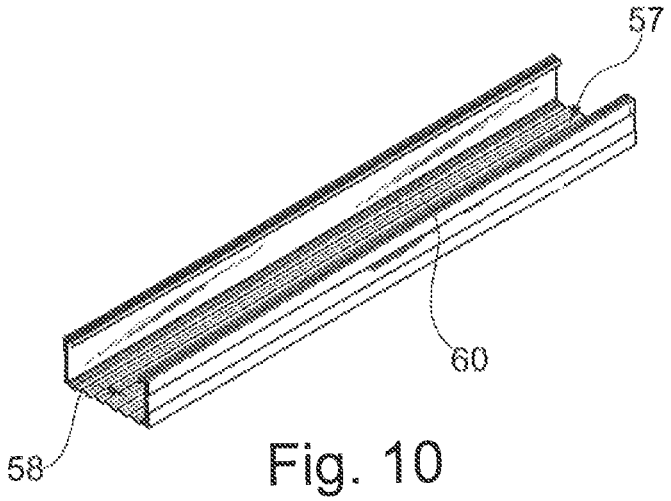
FIG. 10 shows a perspective view of a further embodiment of a longitudinal steel plate frame for a plate-shaped roof element, where the lower plate portion is provided with longitudinal reinforcement corrugations.

FIG. 10 shows a perspective view of a further embodiment for a longitudinal carrying steel frame 57. A bottom part 58, in order to improve the general load carrying capacity, is provided with longitudinal directed corrugations 60.

Figure 11:
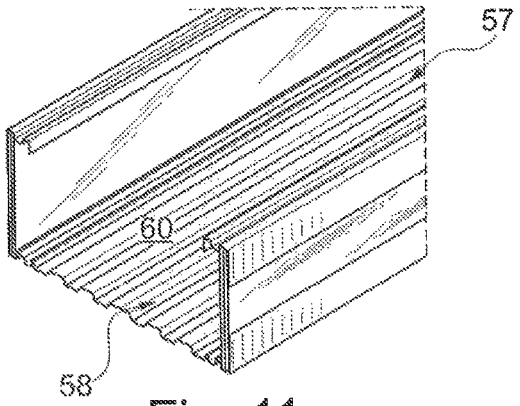
FIG. 11 shows a perspective view of an enlarged end portion of the steel plate frame shown in FIG. 10.

FIG. 11 shows an enlarged view of an end portion of the longitudinal carrying steel frame 57.

Figure 12:
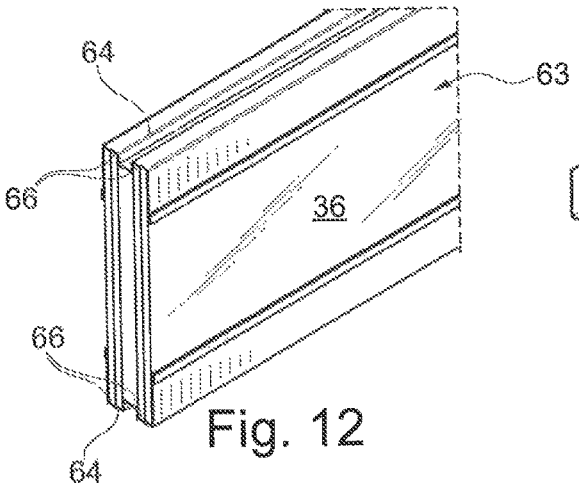
FIG. 12 shows a perspective view of an embodiment of a narrow, longitudinal girder for a plate-shaped roof element according to the invention.

FIG. 12 shows a perspective view of an alternative longitudinal girder construction 63 built-up from two uniform, but inverted steel plate profiles 64 having upper and lower longitudinal corrugations 66, which are interconnected to a number of longitudinal connection plate members 36. Two longitudinal connection plate members of which are present at opposed sides of the girder construction 63.

Advantageously, the connection plate members 36 (PowerBoard®) use an inorganic, fireproof composite material such as Perlite (MgO) reinforced with more layers of glass fiber netting. Power Board® is available in a standard size of 1220×2440 mm, from which the connection plate members 36 may be cut with suitable height and lengths.

The connecting plate members 36 vertical joints are mounted between adjoining connecting plate members which are mutually displaced. The connection plate members are connected to each other and to vertical plate portions of the inverted steel plate profiles 64 and to the side parts of the longitudinal corrugations 68 preferably by gluing. Between the longitudinal connection plate members 36, a layer of semi-hard insulation material is glued.

According to an alternative embodiment the longitudinal plate member 36 may be substituted by other plate material having low thermal conductivity such as stainless steel.

This alternative girder construction 63 may be built-in between longitudinal carrying steel frames 20 according to the invention in order to provide for an alternative manner of improving the carrying capacity and length of free span of prefabricated roof plate elements 6 according to the invention.

Furthermore, the alternative girder construction 63 may be used as a standard carrying girder in order to substitute for more expensive laminated wooden girders or the like.

Figure 13:
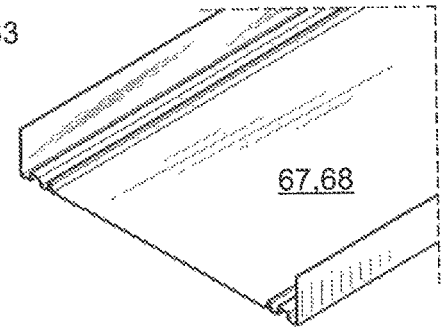
FIG. 13 shows a perspective view of a lower steel plate frame portion similar to that shown in FIG. 8.

FIG. 13 shows an enlarged perspective view of a lower steel plate frame portion 4 similar to that shown in FIG. 8, where a central bottom part is provided with a large number of perforations 67 and possible provided with an upper fabric cover 68 to improve the acoustic qualities of the bottom part of the roof plate element 6. In this connection it is very important that a suitable vapor barrier is arranged directly above the upper fabric cover 68 at the upper side of the central bottom part.

Figure 14:
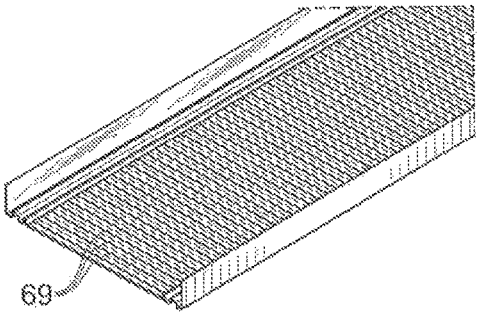
FIG. 14 shows a perspective view of a modified embodiment for lower steel plate frame portion provided with transverse corrugations.

FIG. 14 shows an enlarged perspective view of a modified embodiment for lower steel plate frame portion provided with transverse corrugations 69.

Figure 15:
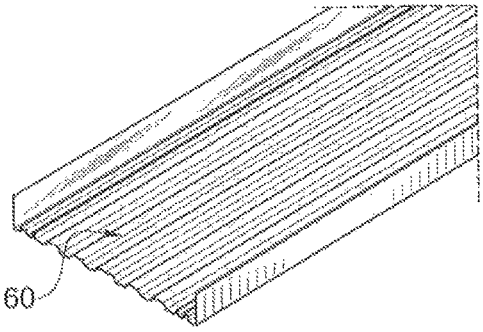
FIG. 15 shows a perspective view of a further modified embodiment for a lower steel plate frame portion provided with longitudinal corrugations.

FIG. 15 shows a perspective view of a further modified embodiment for a lower steel plate frame portion provided with longitudinal corrugations 60.

Figure 5:
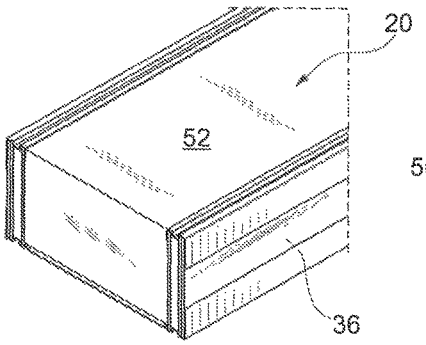
FIG. 5 shows a perspective view illustrating how the steel plate frame parts of the plate-shaped roof element, as seen in FIG. 4, afterwards are filled with a block of insulating material.
Figure 16:
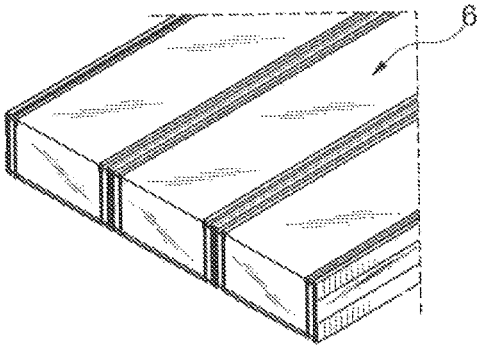
FIG. 16 shows a perspective, partial view of an embodiment for a plate-shaped roof element according to the invention having three assembled plate-shaped roof plate elements as seen in FIG. 5.

FIG. 16 shows an enlarged perspective view of a part of an embodiment for a plate-shaped roof element 6 according to the invention having of three assembled plate-shaped roof plate elements 20 as seen in FIG. 5.

Figure 17:
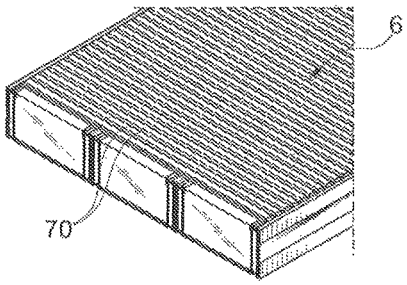
FIG. 17 shows a perspective, partial view of the plate-shaped roof element, as shown in FIG. 16, provided with upper, transverse corrugated steel plate profiles.

FIG. 17 shows an enlarged perspective, partial view of the prefabricated plate-shaped roof element 6 shown in FIG. 16 and provided with upper, transverse corrugated steel plate profiles 70.

Figure 18:
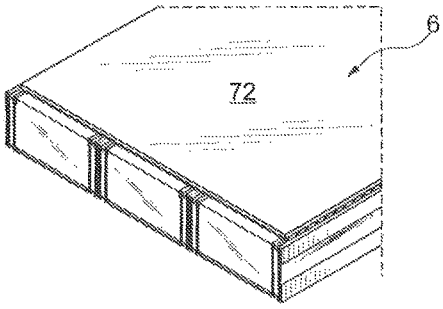
FIG. 18 shows a perspective, partial view of the plate-shaped roof element, as shown in FIG. 17, provided with upper semi-hard plate of insulating material.

FIG. 18 shows an enlarged perspective, partial view of the plate-shaped roof element 6 shown in FIG. 17 and provided with upper semi-hard plates 72 of insulating material.

Figure 19:
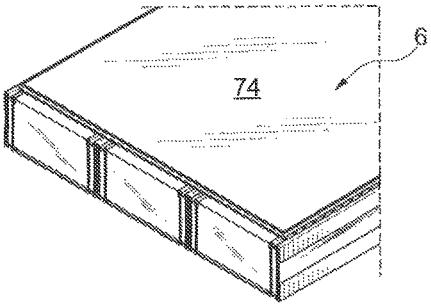
FIG. 19 shows a perspective, partial view of the plate-shaped roof element, as shown in FIG. 18, further provided with an uppermost roof foil material.

FIG. 19 shows an enlarged perspective, partial view of the plate-shaped roof element 6 shown in FIG. 18 and finally provided with an uppermost roof folio covering 74.

Figure 20:
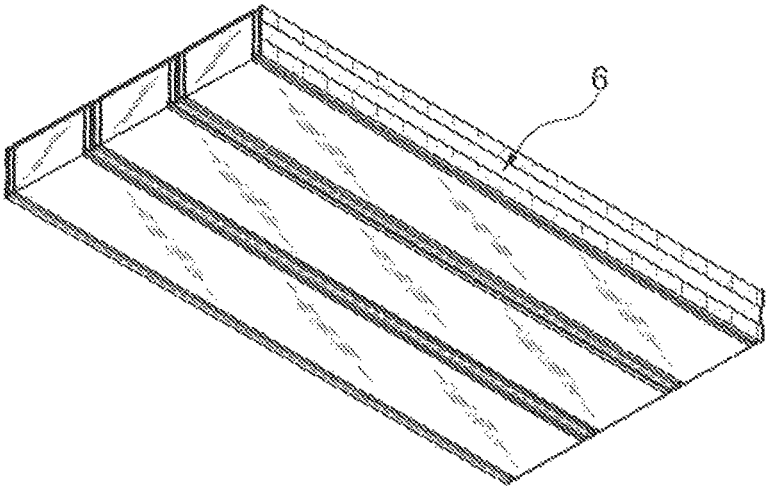
FIG. 20 shows a bottom perspective view of the plate-shaped roof element according to the invention, as shown in FIGS. 16-19.

FIG. 20 shows a lower perspective view of the plate-shaped roof element 6 according to the invention as shown in FIGS. 16-19.

Figure 21:
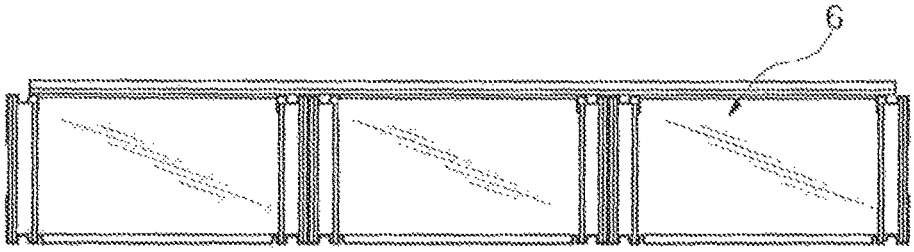
FIG. 21 shows a plane sectional view through the plate-shaped roof element as shown in FIGS. 16-20.

FIG. 21 shows a plane sectional view through the plate-shaped roof element 6 shown in FIGS. 16-20.

Figure 22:
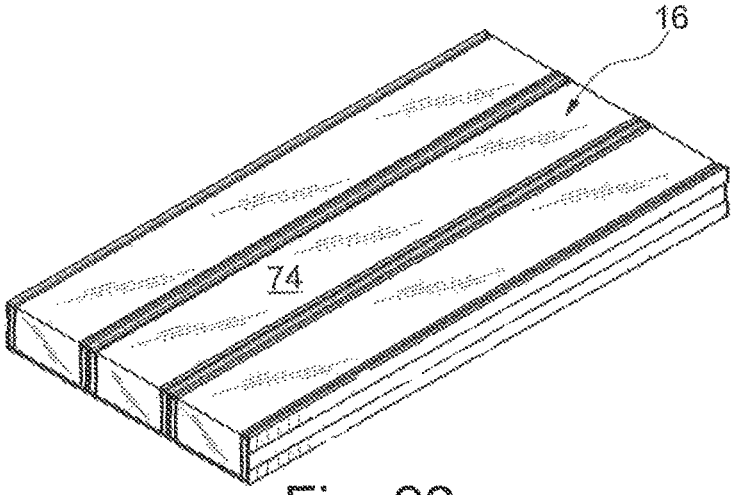
FIG. 22 shows a top perspective view of the plate-shaped roof element according to the invention as shown in FIGS. 16-19.
Figure 23:
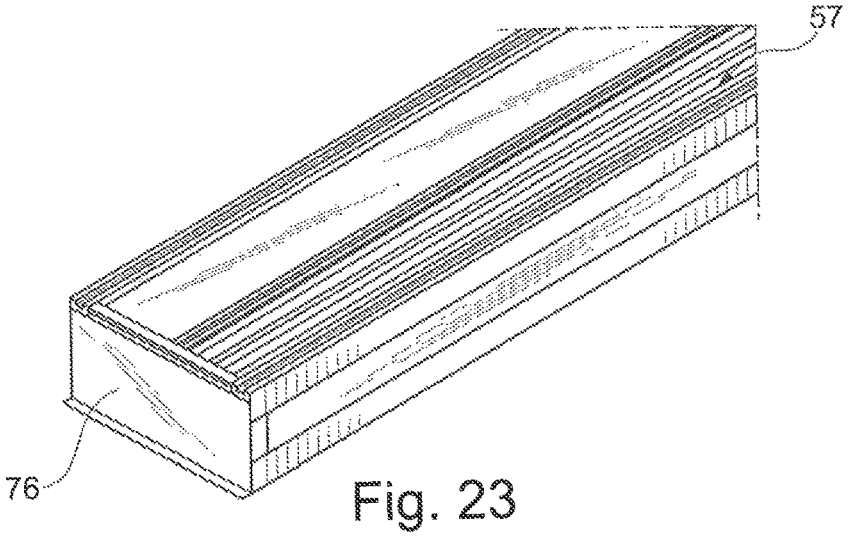
FIG. 23 shows a perspective view of an enlarged end portion of the steel plate frame which is similar to that shown in FIG. 11, provided with an end closing panel.

FIG. 22 shows an upper perspective view of the plate-shaped roof element 6 according to the invention as shown in FIGS. 16-19—as seen from above, FIG. 23 shows a perspective view of an enlarged end portion of the steel plate frame 57 similar to that shown in FIG. 11 and provided with an end closing panel 76.

Figure 24:
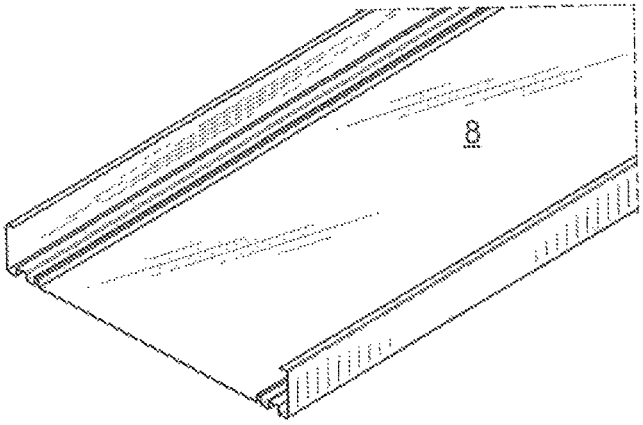
FIG. 24 shows a perspective view of an enlarged end portion of the steel plate frame which is similar to the lower frame portion shown in FIGS. 8 and 9.

FIG. 24 shows a perspective view of an enlarged end portion of the steel plate frame similar to the lower frame portion 8 shown in FIGS. 8 and 9.

Figure 25:
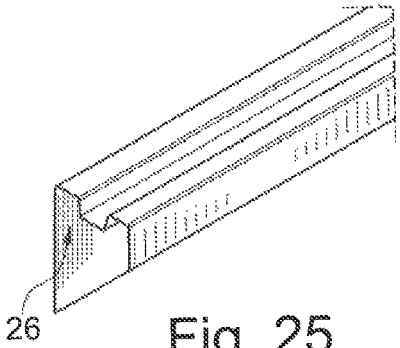
FIG. 25 shows a perspective view of an enlarged end portion of an upper side part of the steel plate frame as shown in the left hand side of FIG. 3.

FIG. 25 shows a perspective view of an enlarged end portion of an upper side part of the steel plate frame 26 shown in the left hand side of FIG. 3.

Figure 26:
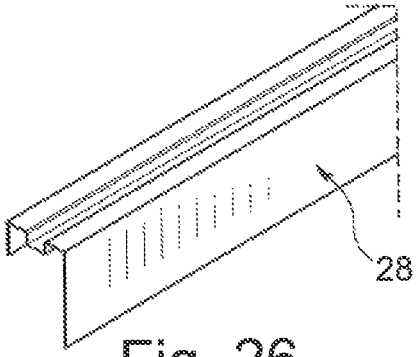
FIG. 26 shows a perspective view of an enlarged end portion of an upper side part of the steel plate frame as shown in the right hand side of FIG. 3.

FIG. 26 shows a perspective view of an enlarged end portion of an upper side part of the steel plate frame 28 shown in the right hand side of FIG. 3.

Figure 27:
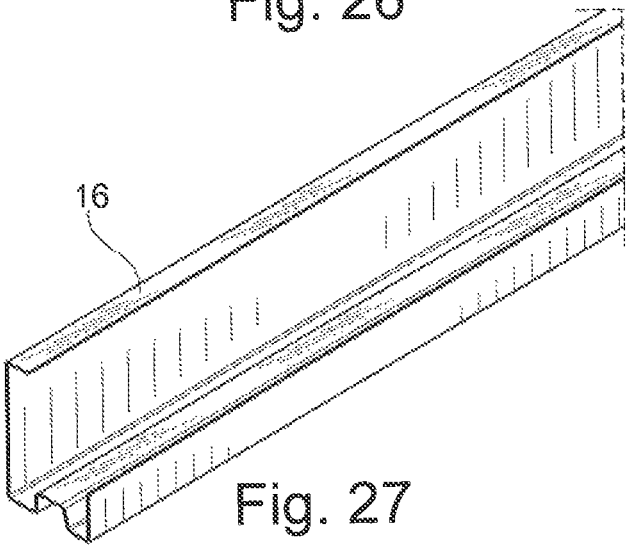
FIG. 27 shows a perspective view of an enlarged end portion of a lower side part of the steel plate frame as shown in the left hand side of FIG. 8.

FIG. 27 shows a perspective view of an enlarged end portion of a lower side part of the steel plate frame 8 shown in the left hand side of FIG. 8.

Figure 28:
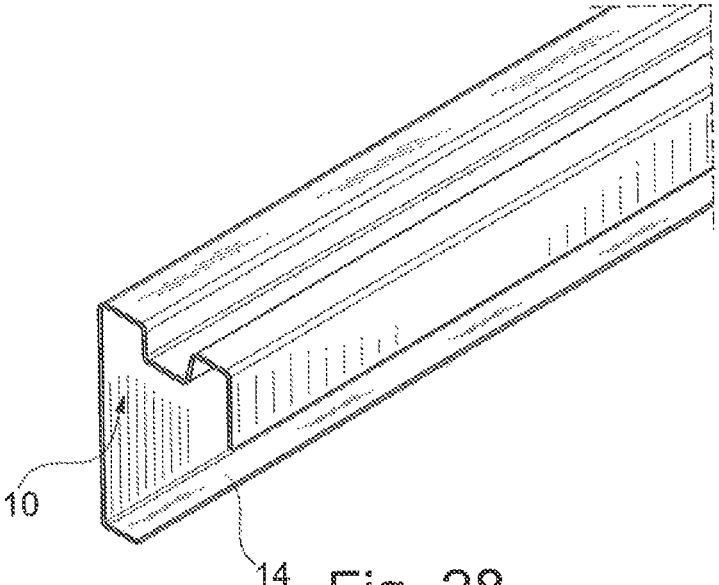
FIG. 28 shows a perspective view of an enlarged end portion of an upper side part of the steel plate frame as shown in the left hand side of FIG. 8.

FIG. 28 shows a perspective view of an enlarged end portion of the upper left steel plate frame 10 shown in the left hand side of FIG. 8.

The general width of each of the longitudinal steel plate frames 8, 20, 34 and 54 is between 500 and 1500 mm. The total width of three interconnected longitudinal steel plate frames may vary from 1500 and 4500 mm. Normally, allowing for the maximum for road transportation, the total width may vary from 3000-3600 mm.

The height of the side panels of the lower steel plate frame 8 comprising the longitudinal bend-in edges 14 and 16 (FIGS. 1 and 2) may vary from 50-200 mm and the height of the upper left and right hand side panels 10 and 12 may vary from 50-500 mm.

The height of the side panels 30 and 32 of the upper longitudinal steel plate frames 26 and 28 (FIG. 3) may be about 150 mm and the height of the side panels 22 and 24 of the lower longitudinal steel plate frame 20 may be about 100 mm.

As mentioned above, a prefabricated roof plate element 6, as shown in FIGS. 16-22, may preferably have three interconnected side-by-side longitudinal steel plate frames 20 (FIG. 5). The production is preferably organized in such a manner that in three separate production lines the longitudinal steel plate frames 20 are produced and the cavities thereof are filled with insulation material.

At the ends of the three production lines predetermines lengths of the longitudinal steel plate frames 20 which are moved transversely against each other for interconnection side by side by gluing or by other connecting means. Thereafter, mounting the transverse metal profiles 70 on top of the already interconnected longitudinal steel plate frames 20 to form a plate-shaped roof plate element 6 occurs. Then semi-hard insulation plate members 72 and finally on top thereof are mounted a roof foil covering 74.

Figure 29:
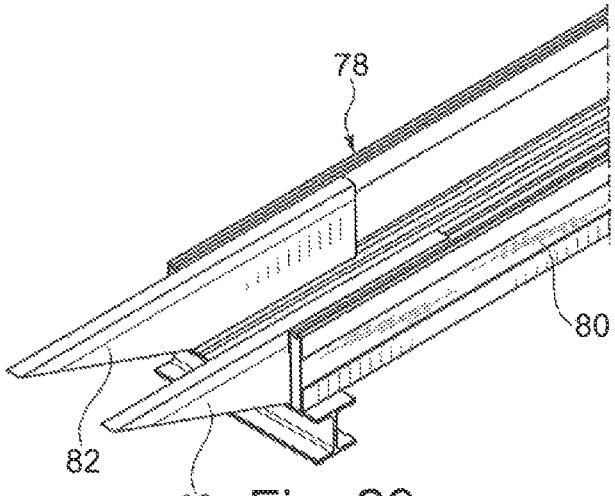
FIG. 29 shows a perspective view of an end part of a prefabricated roof element provided with an inclined end part used for forming eaves.

FIG. 29 shows a perspective view of an end part 78 of a prefabricated roof element 80 provided with inclined end parts 82 for forming inclined eaves 84.

Figure 30:
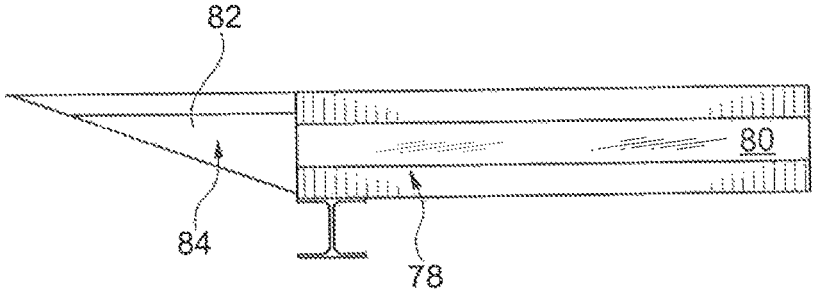
FIG. 30 show a plane side view of the end part shown in FIG. 29.

FIG. 30 shows a plane side view of the end part 78 shown in FIG. 29.

Figure 31:
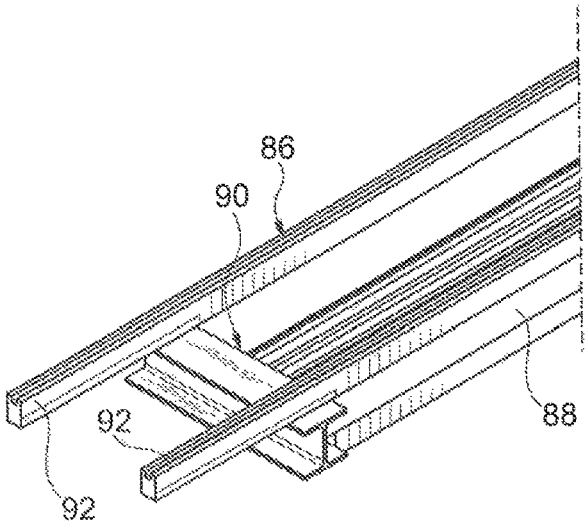
FIG. 31 shows a perspective view of an end part of a prefabricated roof element provided with a reduced height at an end part used for forming eaves.

FIG. 31 shows a perspective view of an end part 86 of a prefabricated roof element 88 provided with a reduced height at an end part 90 intended for forming upper eaves 92.

Figure 32:
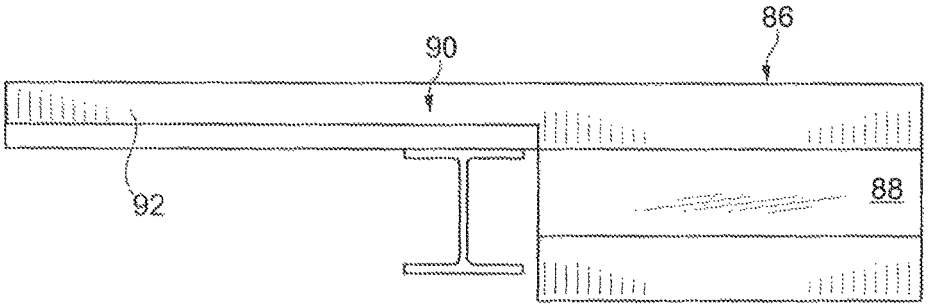
FIG. 32 shows a plane side view of the end part shown in FIG. 31

FIG. 32 shows a plane side view of the end part 86 shown in FIG. 31.

Figure 33:
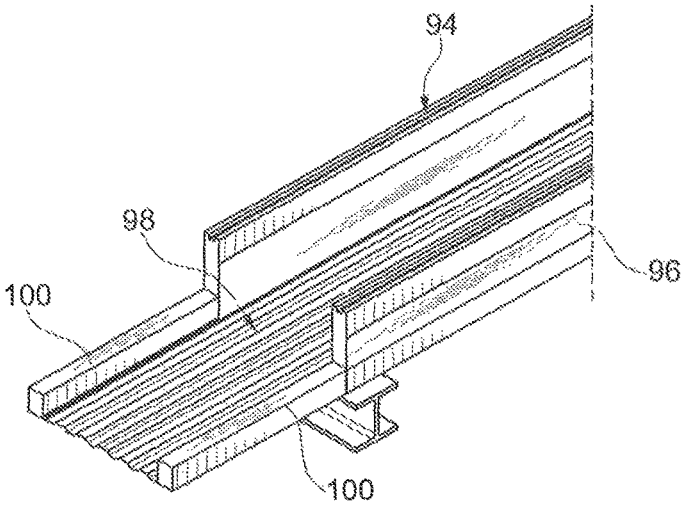
FIG. 33 shows a perspective view of an end part of a prefabricated roof element provided with a reduced height at an end part used for forming eaves.

FIG. 33 shows a perspective view of an end part 94 of a prefabricated roof element 96 provided with a reduced height at an end part 98 for forming lower eaves 100.

Figure 34:
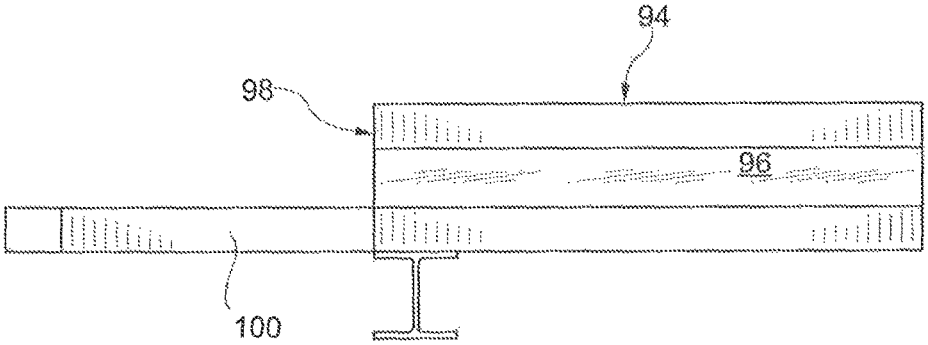
FIG. 34 shows a plane side view of the end part shown in FIG. 33.

FIG. 34 shows a plane side view of the end part 94 shown in FIG. 33.

Figure 35:
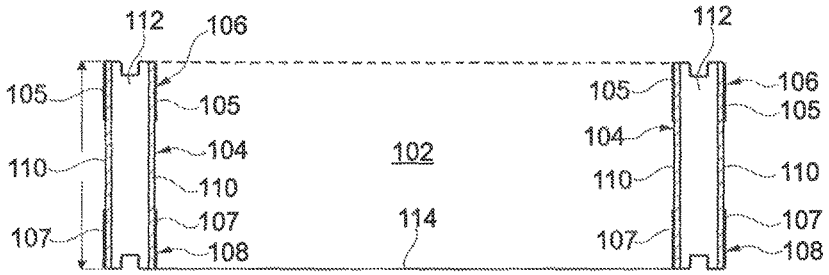
FIG. 35 shows a plane sectional view of another embodiment of a plate-shaped roof element according to the invention.
Figure 36A:
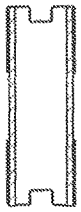
FIGS. 36A-36C show plane sectional views through embodiments of carrying girders for use in plate-shaped roof elements according to the invention.
Figure 36B:
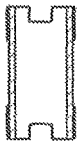
Figure 36C:
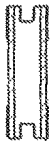
Figure 37A:
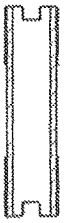
FIGS. 37A-37C show plane sectional views through further embodiments of carrying girders for use in plate-shaped roof elements according to the invention.
Figure 37B:
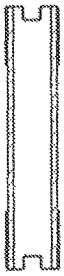
Figure 37C:
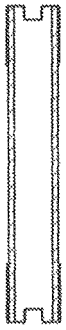

FIG. 35 shows a plane sectional view through an alternative embodiment for a plate-shaped roof element 102 according to the invention. The roof element 102 is built up from two load carrying girders 104, each having upper and lower corrugated frame profiles 106 and 108 bend up from a thin steel plate. The longitudinal vertical edge parts 105 and 107 being interconnected by rigid connection plates 110. The hollow portion between the connection plates 10 is filled with semi-hard plate-shaped insulation material 112.

Afterwards, the girders, possibly in situ, are interconnected with a lower bottom plate member 114 formed the ceiling in the building in question. Finally, the hollow portion between the load carrying girders 104 is filled with a suitable insulation material, before the plate-shaped roof element 102 is closed upwardly by profiled steel plates and a suitable roof foil covering.

Preferably, the connections between the vertical edges 105 and 107 and the rigid connection plates 110 are made by gluing.

FIGS. 36A-C and FIGS. 37A-C show cross sections illustrating six different widths and heights of the load carrying girders 104, which in practice may vary considerably.

Figure 38:
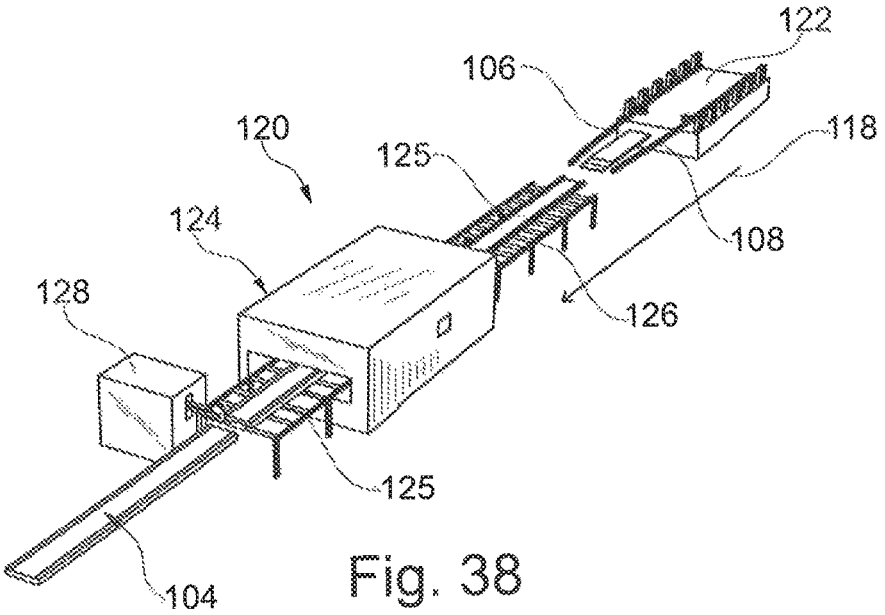
FIG. 38 shows a perspective view of a plant for the continuously production of load carrying girders according to the invention.
Figure 39:
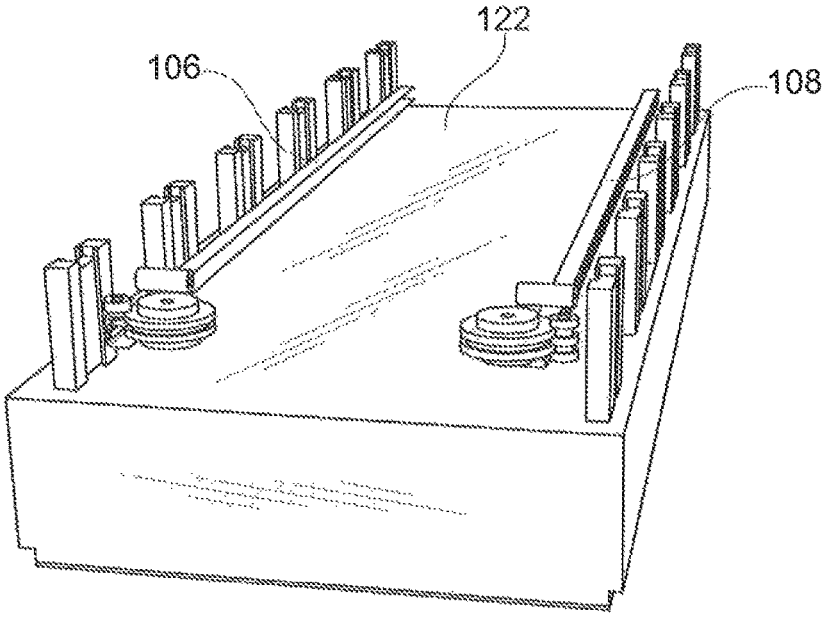
FIG. 39 shows a perspective view of an embodiment for a profile press station for bending up upper and lower steel frame profiles for load carrying girders according to the invention.
Figure 40:
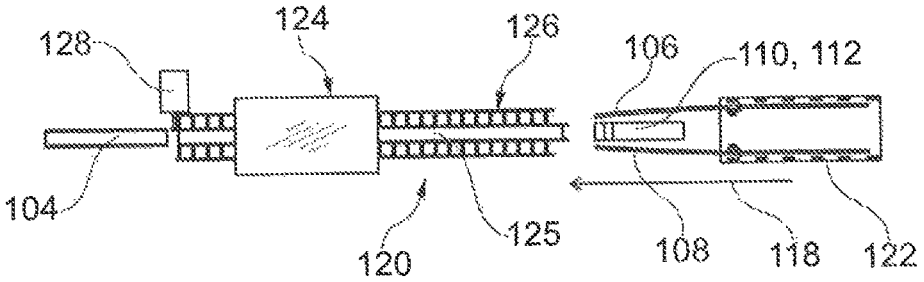
FIG. 40 shows a plane top view of the production plant shown in FIG. 38.

FIGS. 38 and 40 show a perspective and a plane view, respectively, of an embodiment of a production plant 120 for the continuous production of load carrying girders 104. Initially, upper and lower frame profiles 106 and 108 successively bend upward from straight steel bands at the profile press station 122. The direction of production is marked with an arrow 118.

Figure 41:
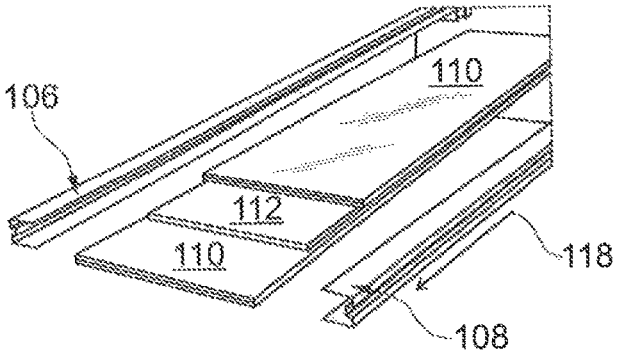
FIG. 41 shows a perspective view of the assembling details of the production plant shown in FIG. 38.
Figure 42:
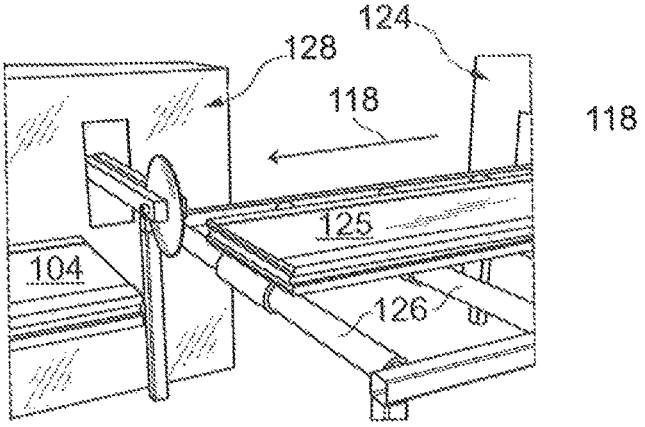
FIG. 42 shows a perspective view of a cutting station of the production plant shown in FIG. 38.

Then, the rigid connection plates 110 are assembled at both sides of a semi-hard plate-shaped insulation material 112 with the upper and lower corrugated frame profiles 106 and 108 by suitable gluing (FIG. 41). which occurs before the assembled load carrying girder member 125, supported on a roller conveyor 126, pass through a hardening station 124. After the hardening station 124, the assembled load carrying girder member 125 arrives at a cutting station 128 (FIG. 42) where the final predetermined length of the load carrying girders 104 are determined.

As mentioned above, an important aspect of the present invention is possible in situ production of both load carrying girders 104 and the assembling of prefabricated plat-shaped roof elements organized by a mobile production plan build-up in one or more containers on buildings.

REFERENCE NUMERALS FROM THE DRAWING

2 thin steel blank
4 longitudinal carrying steel frames
6 prefabricated plate-shaped roof element
8 longitudinal lower steel frame part
10 upper left hand side plate-shaped frames
12 upper right hand side plate-shaped frames
14 upper narrow bend-in edges
16 lower narrow bend-in edges
18 wider lower steel frame
20 longitudinal carrying steel frames
22 lower left hand side vertical side panels
24 lower right hand side vertical side panels
26 upper left hand side steel frame part
28 upper right hand side steel frame part
30 left vertical side wall panels
32 right vertical side wall panels
34 girder-like constructions
36 longitudinal, vertical connection plate members
38 upper longitudinal corrugations
40 lower longitudinal corrugations
42 upper wall parts of 20
44 lower wall parts of 20
46 left hand side innermost side wall panels
48 right hand side innermost side wall panels
50 narrow cavities between connection plate members
52 central cavities of 20
54 alternative embodiment longitudinal carrying steel frame part
56 longitudinal connection plate members
57 alternative longitudinal carrying steel frames
58 upper longitudinal corrugations
60 lower longitudinal corrugations
62 suitable insulation materials
63 girder-like constructions
64 uniform inverted plate profiles
66 upper and lower longitudinal corrugations
67 perforations
68 upper fabric cower
69 transverse corrugations
70 upper transverse corrugated steel profiles
72 semi-hard insulation materials
74 uppermost roof foil material
76 end closing profile
78 end part of prefabricated roof element
80 prefabricated roof element
82 inclined end part
84 eaves
86 end part of prefabricated roof element
88 prefabricated roof element
90 end part with reduced height
92 eaves
94 end part of prefabricated roof element
96 prefabricated roof element
98 end part with reduced height

100 eaves
102 plate-shaped roof element
104 load carrying girder
105 upper vertical edges
106 upper corrugated frame profile
107 lower vertical edges
108 lower corrugated frame profile
110 rigid longitudinal connection plates
112 semi-hard plate-shaped insulation material
114 lower button plate member
118 direction arrow
120 production plant
122 profile press station
124 hardening station
125 load carrying girder member
126 roller conveyor
128 cutting station

The invention claimed is:

1. A prefabricated roofing plate element comprising:

first and second load-bearing girders, each of said first and second girders including a steel upper frame part providing a corrugated top wall and a downwardly-extending outer side panel, a steel lower frame part providing a corrugated bottom wall and an upwardly-extending outer side panel, and a first longitudinal connection plate member having a lower edge which extends into a corrugation cavity in the lower frame part and an upper edge which extends into a corrugation cavity in the upper frame part, the first longitudinal connection plate member being connected to the downwardly-extending outer side panel and the upwardly-extending outer side panel, and a steel panel part which extends between, and is integral with, the bottom walls of the lower frame parts of the first and second girders.

2. The prefabricated roofing plate member according to claim 1, each of the first and second girders includes a second longitudinal connection plate member which has a lower edge that extends into a corrugation cavity in the lower frame part and an upper edge that extends into a corrugation cavity in the upper frame part.

3. The prefabricated roofing plate element according to claim 2, wherein in each of the first and second girders the longitudinal upper frame member provides a downwardly-extending inner side panel, the longitudinal lower frame part provides an upwardly-extending inner side panel, and the second plate member is connected to both the downwardly-extending inner side panel of the upper frame member and to the upwardly-extending inner side panel of the lower frame part.

4. The prefabricated roofing plate element according to claim 3, including insulation material between the first and second plate members of each of the first and second girders.

5. The prefabricated roofing plate element according to claim 3, including insulation material in a central cavity provided above the steel panel part and between the first and second girders.

6. The prefabricated roofing plate element according to claim 1, wherein the steel panel part includes perforations.

7. The prefabricated roofing plate element according to claim 1, wherein the steel panel part includes longitudinal corrugations.

8. The prefabricated roofing plate element according to claim 1, wherein the steel panel part includes transverse corrugations.

9. The prefabricated roofing plate element according to claim 1, wherein each of the longitudinal connection plate members is substantially flat.

10. The prefabricated roofing plate element according to claim 1, wherein each of the longitudinal connection plate members comprises composite material reinforced with layers of glass fibre netting.

* * * * *